US009723678B2

(12) United States Patent
Sedzin et al.

(10) Patent No.: US 9,723,678 B2
(45) Date of Patent: Aug. 1, 2017

(54) METHODS OF CONTROLLING RGBW LAMPS, RGBW LAMPS AND CONTROLLER THEREFOR

(71) Applicant: NXP B.V., Eindhoven (NL)

(72) Inventors: Aliaksei Sedzin, Eindhoven (NL); Marc Vlemmings, Eindhoven (NL)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 15/061,310

(22) Filed: Mar. 4, 2016

(65) Prior Publication Data

US 2017/0027037 A1 Jan. 26, 2017

(30) Foreign Application Priority Data

Mar. 6, 2015 (EP) ..... 15158079

(51) Int. Cl.
*H05B 37/02* (2006.01)
*H05B 33/08* (2006.01)

(52) U.S. Cl.
CPC ..... *H05B 33/0857* (2013.01); *H05B 33/086* (2013.01); *H05B 33/0845* (2013.01)

(58) Field of Classification Search
CPC ..... H05B 33/0818; H05B 33/0854; H05B 33/0863; H05B 33/0872; H05B 37/0254
USPC ..... 315/307, 309, 312
See application file for complete search history.

(56) References Cited

U.S. PATENT DOCUMENTS 6,495,964 B1 * 12/2002 Muthu ..... F21V 9/10 250/214 AL
2006/0049782 A1 * 3/2006 Vornsand ..... H05B 33/0869 315/312
2009/0046453 A1 * 2/2009 Kramer ..... F21K 9/00 362/231
2010/0188022 A1 * 7/2010 Gerlach ..... H05B 37/02 315/312

(Continued)

FOREIGN PATENT DOCUMENTS

EP 1662583 A1 5/2006
JP 2008288412 11/2008

(Continued)

OTHER PUBLICATIONS

Extended European Search Report for Patent Application No. 15158079.2 (Nov. 5, 2015).

*Primary Examiner* — Tung X Le

(57) ABSTRACT

A method, controller and lighting circuit are disclosed: the variation of chromaticity and luminosity of LEDs as a function of temperature over an operating temperature range is characterized; virtual LEDs, including a virtual white are defined, such that the chromaticity of each virtual LED can be achieved by combining component light from the LEDs for all temperatures within the operating range; the requested settings R, G, B of each of three primary colors, defining a requested chromaticity and a requested luminance, are used to determine a virtual white control setting corresponding to a maximum fraction of a total luminance at the requested chromaticity which can be provided by the virtual white LED; control settings for each of the other LEDs are thereby determined, and the setting for each of the LEDs is determined from the sum of that LED's component of the virtual LEDs.

15 Claims, 6 Drawing Sheets

(56) References Cited

U.S. PATENT DOCUMENTS

| | | | | |
|---|---|---|---|---|
| 2011/0018465 | A1* | 1/2011 | Ashdown | H05B 33/0818 315/294 |
| 2012/0038287 | A1* | 2/2012 | Li | H05B 33/0854 315/250 |
| 2013/0049602 | A1* | 2/2013 | Raj | H05B 33/0869 315/151 |
| 2014/0035465 | A1 | 2/2014 | Raj et al. | |

FOREIGN PATENT DOCUMENTS

| | | | |
|---|---|---|---|
| WO | WO-0247438 | A2 | 6/2002 |
| WO | WO-0247438 | A3 | 6/2002 |
| WO | WO-2010/150119 | A2 | 12/2010 |

* cited by examiner

| | WF | R | G | B | Rc | Gc | Bc | Wc | NEED to scale | F1*F2 | Rc (scaled) | Gc (scaled) | Bc (scaled) | Wc (scaled) |
|---|---|---|---|---|---|---|---|---|---|---|---|---|---|---|
| 701 | 0.50 | 255 | 255 | 255 | 255 | 255 | 255 | 255 | 0 | 1.000 | 255 | 255 | 255 | 255 |
| 702 | 0.50 | 0 | 255 | 255 | 0 | 510 | 510 | 0 | 1 | 0.500 | 0 | 255 | 255 | 0 |
| 703 | 0.50 | 0 | 0 | 255 | 0 | 0 | 510 | 0 | 1 | 0.500 | 0 | 0 | 255 | 0 |
| 704 | 0.50 | 127 | 127 | 127 | 0 | 0 | 0 | 254 | 0 | 1.000 | 0 | 0 | 0 | 254 |
| 705 | 0.50 | 127 | 127 | 254 | 0 | 0 | 254 | 254 | 0 | 1.000 | 0 | 0 | 254 | 254 |
| 706 | 0.50 | 50 | 50 | 50 | 0 | 0 | 0 | 100 | 0 | 1.000 | 0 | 0 | 0 | 100 |
| 707 | 0.50 | 20 | 30 | 50 | 0 | 20 | 60 | 40 | 1 | 0.833 | 0 | 17 | 50 | 33 |
| 708 | 0.50 | 50 | 200 | 255 | 0 | 300 | 410 | 100 | 1 | 0.622 | 0 | 187 | 255 | 62 |
| | | | | | | | | | | | | | | |
| 709 | 0.75 | 255 | 255 | 255 | 255 | 255 | 255 | 255 | 0 | 1.000 | 255 | 255 | 255 | 255 |
| 710 | 0.75 | 0 | 255 | 255 | 0 | 1020 | 1020 | 0 | 1 | 0.250 | 0 | 255 | 255 | 0 |
| 711 | 0.75 | 0 | 0 | 255 | 0 | 0 | 1020 | 0 | 1 | 0.250 | 0 | 0 | 255 | 0 |
| 712 | 0.75 | 191 | 191 | 191 | 0 | 0 | 0 | 255 | 0 | 1.000 | 0 | 0 | 0 | 255 |
| 713 | 0.75 | 191 | 191 | 255 | 0 | 0 | 256 | 255 | 1 | 0.996 | 0 | 0 | 255 | 254 |
| 714 | 0.75 | 50 | 50 | 50 | 0 | 0 | 0 | 67 | 0 | 1.000 | 0 | 0 | 0 | 67 |
| 715 | 0.75 | 20 | 30 | 50 | 0 | 40 | 120 | 27 | 1 | 0.417 | 0 | 17 | 50 | 11 |
| 716 | 0.75 | 50 | 200 | 255 | 0 | 600 | 820 | 67 | 1 | 0.311 | 0 | 187 | 255 | 21 |

FIG. 7

METHODS OF CONTROLLING RGBW LAMPS, RGBW LAMPS AND CONTROLLER THEREFOR

CROSS-REFERENCE TO RELATED APPLICATIONS

This application claims the priority under 35 U.S.C. §119 of European patent application no. 15158079.2, filed Mar. 6, 2016 the contents of which are incorporated by reference herein.

FIELD

The present disclosure relates to systems and methods of controlling colour controllable RGBW lamps which are also known as four-colour lamps, to controllers configured to operate such methods, and to four colour lamps.

BACKGROUND

Colour-controllable lamps typically include three light sources, respectively producing red (R), green (G) and blue (B) outputs. By controlling the intensity of each of the three light sources, a user may control of both the perceived colour, or chromaticity, and the luminance, or intensity, of the lamp.

The perceived colour, or chromaticity, may be represented by two colour coordinates x and y, according to the CIE 1931 standard. This standard plots, on a two-dimensional chart, the perceived colour of light: FIG. 1 shows the chart in block form. Around the perimeter of the chart is shown the spectrum of fundamental frequencies ranging from red (R), through orange (O), yellow (Y), green (G), blue (B), Indigo (I) and violet (V). The interior of the chart demonstrates various mixtures of the colours, with the central area corresponding to white light (W). Also shown on the figure is the black body radiation curve, corresponding to the colour of radiation emitted by a black body, which follows a path from the right to the left with increasing temperature.

It will be appreciated that a user has 3 degrees of freedom in controlling the lamp—that is to say the magnitude of the each of the red, green and blue channels. Two of these degrees of freedom control the chromaticity of the output, and the third degree controls the intensity. In the case of, for instance, 12-bit digital control where each of R, G and B can be assigned values between 0 and 4095, and ignoring the variation of perceived intensity with frequency, the sum R+G+B is indicative of the luminance, and the ratios B/R and G/R are indicative of chromaticity. Of course any other two pairs of ratios may be used; the third ratio will be determined from the two pairs of ratios and the sum.

In an ideal situation, the three light sources are "perfect" in the sense that they produce respectively monochromatic R, G and B light, which has a fixed chromaticity—that is to say it has fixed X and Y, colour-coordinates, independent of operating conditions such as intensity or operating temperature.

In practice, LED light sources produce light of which the dominant frequency and width of the frequency spectrum vary with both operating temperature and intensity. Thus, correction factors have to be applied to the user inputs when controlling a RGB colour controllable LED lamp.

Recently there has been a trend towards adding a fourth, white (W), LED, to the three colour LEDs. White LEDs are generally fundamentally different to coloured monochromatic LEDs, in fact in a white LED the light output is not produced directly from an electronic transition within the device—typically from a p-n junction; rather the LED includes a phosphor, which convert a fraction of the blue light generated by the p-n junction to visible yellow light, which together generate visible white light; nonetheless the resulting white light output from a white LED also varies with operating temperature and intensity.

Control methods are known which include correction for the variation of LED output for three colour RGB LED lamps, with operating temperature. For four colour RGBW lamps, such corrections may be far more complex.

SUMMARY

According to a first aspect of the present disclosure, there is provided a method of controlling a lamp comprising first, second, third colour LEDs and a white LED, the method comprising: characterising the variation of chromaticity and luminosity of each of the LEDs as a function of temperature over an operating temperature range; defining each of a virtual first, virtual second and virtual third LED, such that the chromaticity of each virtual LED can be achieved by combining light from the first, second and third LEDs for all temperatures within the operating range; defining a virtual white LED, such that the chromaticity of the virtual white LED can be achieved by combining light from the white LED with light from a two of the first, second and third LEDs, for all temperatures within the operating range; receiving data representative of a requested setting R, G, B of each of three primary colours, thereby defining a requested chromaticity and a requested luminance; determining an operating temperature of each LED; determining a virtual white control setting Wc corresponding to a maximum fraction of a total luminance at the requested chromaticity which can be provided by the virtual white LED; determining a control setting Rc, Gc, and Bc for each of the respective first, second and third virtual LEDs, in dependence on the difference between the requested setting of the respective primary colour and the control setting of the virtual white LED; controlling each of the first, second and third LED with a respective output control setting which is sum of the respective first LED, second LED or third LED components of the virtual white, virtual first, virtual second and virtual third LED control settings at the operating temperature; and controlling the white LED with an output control setting which is the white LED component of the virtual white LED.

Defining a virtual white LED may simplify the calculation of the overall colour-intensity combination which may be provided by the real white LED, and by determining a virtual white control setting corresponding to a maximum fraction of a total luminance at the requested chromaticity which can be provided by the virtual white LED, the calculation of the colour-intensity combination which may be provided by the real white LED may be simplified, compared with known solutions.

As will be explained in more detail hereinbelow, the virtual white LED is constructed from light from the white LED and only two of the other LEDs—in the case that the white LED is a so-called warm white LED, these are typically green and blue LEDs, whereas in the case that the white LED is a so-called cool white, the two colour LEDs are typically red and green LEDs. As a result one of the first LED, second LED or third LED components of the virtual white light will be equal to zero. As an example, in the case of the first, second, and third LEDs being respectively red, green and blue LEDs, and the white LED being a warm white, the first LED components, that is to say the red component, of the virtual white LED is zero.

The steps of characterising the variation of chromaticity and luminosity of each of the LEDs; defining each of a virtual first, virtual second and virtual third LED, and defining a virtual white LED, may each be carried out in a characterisation phase for combination of particular types of LED. Information or data corresponding to the characterisation and definitions may be stored in a controller, configured according to one or more embodiments as will be discussed in more detail hereinbelow, for use in methods according to one or more embodiments. The remaining steps may be carried out periodically during operation of such a four-colour lamp. For example they may be carried out on a regular basis, for instance once every second, in order to account for variations in temperature; alternatively and without limitation that they may be carried out whenever the control settings to the lamp are changed.

In one or more embodiments, the method further comprises scaling the output of each LED, by a scale factor equal to the ratio of the maximum of allowable Rc Gc and Bc to the maximum of Rc, Gc and Bc, according to Scale factor=Max (Rc, Gc, Bc)/range, where range is defined by a maximum allowable control setting for any of the coloured LEDs. Inclusion of a scale factor may prevent the requested control signals for one or more of the LEDs from going outside its allowed range, and may allow for good colour rendering, by ensuring that the chromaticity of any output light is in accordance with the requested chromaticity.

In one or more embodiments, the method further comprises scaling the output of each LED, by a scale factor equal to the ratio of the largest of R, G and B to the largest of Rc, Gc and Bc, according to $$\text{Scale factor}=\text{Max}(R,G,B)/\text{Max}(Rc,Gc,Bc).$$

Inclusion of such a scale factor may provide for good colour rendering, as already mentioned; it may further provide a smooth transition in the case that the lamp is not able to provide the requested colour-intensity combination; the smooth transitions may avoid observable step changes or caps in the variation of output intensity with requested intensity.

In one or more embodiments, the virtual white control setting Wc is determined according to Wc=Min(R,G,B)/WF, provided at least one of R, G, and B is less than a white fraction WF, and maximum otherwise, where the white fraction WF is defined as the maximum fraction of the luminance of the lamp which may be provided from the white LED, when operated at its maximum brightness at the virtual white chromaticity. This may allow the white LED to be used at the maximum intensity possible for each requested colour-intensity combination.

In one or more embodiments, the virtual first, virtual second and virtual third control setting Rc, Gc and Bc respectively to be provided by each of the respective virtual LEDs are respectively determined according to $$Rc=(R-Wc*WF)/(1-WF);$$

$$Gc=(G-Wc*WF)/(1-WF), \text{ and}$$

$$Bc=(B-Wc*WF)/(1-WF).$$

In one or more embodiments, determining an operating temperature of each LED comprises measuring a voltage across the LED at an operating current which is no more than 1/1,000 of a normal operating current for the LED. Such a measurements may allow for so-called "sensorless sensing" of the LED temperature. In other embodiments the temperature at the junction may be directly measured.

In one or more embodiments, the white LED is a warm white LED and the virtual white LED is defined such that the chromaticity of the virtual white LED can be achieved by combining light from the white LED with light from the third and second LEDs, for all temperatures within the operating range. In one or more other embodiments, the white LED is a cool white LED and the virtual white LED is defined such that the chromaticity of the virtual white LED can be achieved by combining light from the white LED with light from the first and second LEDs, for all temperatures within the operating range.

In one or more embodiments, the virtual white LED has a chromaticity corresponding to a correlated colour temperature of 5,700K. Choosing this chromaticity for the virtual white LED may be particular convenient, since it lies on the blackbody radiation curve, and is displaced from the typical chromaticity of both a physical or real warm white LED and a physical or real cool white LED, which may thereby simplify the correction for operating temperature.

According to another aspect of the present disclosure, there is provided a controller for a lamp comprising first, second, third colour LEDs and a white LED, the controller comprising: a memory module for storing data indicative of the variation of chromaticity and luminosity of each of the LEDs as a function of temperature over an operating temperature range; a further memory module for storing data indicative of each of a virtual first, virtual second and virtual third LED; a module configured to define a virtual white LED; an input module, configured to receive data representative of a requested setting R, G, B of each of three primary colours, thereby defining a requested chromaticity and a requested luminance, and to receive data indicative of an operating temperature of each LED; a virtual white control setting module configured to determine a control setting of the virtual white LED corresponding to a maximum fraction of a total luminance at the requested chromaticity; a colour control setting module configured to determine a control setting Rc, Gc, and Bc for each of the respective first, second and third virtual LEDs, in dependence on the difference between the requested setting of the respective primary colour and the control setting of the virtual white LED; and an output module configured to output a respective output control setting for each of the first, second and third LED which is sum of the respective first, second or third components of the virtual white, virtual first, virtual second and virtual third LED control settings at the operating temperature.

The maximum fraction of a total luminance at the requested chromaticity, may be a maximum fraction of a total luminance at the requested chromaticity which can be provided by the virtual white LED.

The virtual first, virtual second and virtual third LED may be chosen such that the chromaticity of each virtual LED can be achieved by combining light from the first, second and third LEDs for all temperatures within the operating range; the virtual white LED may be defined such that, such that the chromaticity of the virtual white LED can be achieved by combining light from the white LED with light from a two of the first, second and third LEDs, for all temperatures within the operating range In one or more embodiments, the controller comprises a scaling module. The scaling module may be configured to configured to scale the control setting Rc, Gc and Bc, Wc of each virtual LED by a scale factor equal to the ratio of the maximum allowable Rc, Gc and Bc to the maximum of Rc, Gc and Bc, in the event only that Max(Rc, Gc, Bc)>range, according to: scale factor=range/Max (Rc, Gc, Bc), where range is defined by a maximum allowable control setting for any of the colour LEDs. In one or other embodiments, the scaling module may be configured to scale the control setting Rc, Gc and Bc, Wc of each LED, by a scale factor equal to the ratio of the maximum of R, G and B to the maximum of Rc, Gc and Bc, in the event only that Max(Rc, Gc, Bc)>Wc, according to: scale factor=Max(R, G, B)/Max (Rc, Gc, Bc).

In one or more embodiments, the virtual white control setting module is configured to determine the virtual white control setting Wc according to: Wc=Min(R, G, B)/WF, provided at least one of R, G, and B is less than a white fraction WF, and maximum otherwise, where the white fraction WF is defined as the maximum fraction of the luminance of the lamp which may be provided from the white LED, when operated at its maximum brightness at the virtual white chromaticity. Furthermore, the virtual colour control setting module may be configured to determine the virtual first, virtual second and virtual third control setting Rc, Gc and Bc respectively to be provided by each of the respective virtual LEDs are respectively determined according to $$Rc=(R-Wc*WF)/(1-WF);$$

$$Gc=(G-Wc*WF)/(1-WF), \text{ and}$$

$$Bc=(B-Wc*WF)/(1-WF).$$

In one or more embodiments, the first LED is a red LED, so the virtual first LED is a virtual red LED, the second LED is a green LED, so the virtual second LED is a virtual green LED, and the third LED is a blue LED, so the virtual third LED is a virtual blue LED. However, it will be appreciated that the disclosure is not limited thereto, and may extend to other combinations of LEDs: in particular, in other embodiments, the first LED may be a yellow LED, and the second LED a lime LED. In such embodiments, the first and second virtual LEDS are respectively virtual yellow and virtual lime LEDs. In still other embodiments, without limitation, the first, second and third LEDs are respectively cyan, yellow and magenta, and the virtual LEDs are respectively virtual cyan, virtual yellow and virtual magenta.

There may be provided a computer program, which when run on a computer, causes the computer to configure any apparatus, including a circuit, controller, sensor, filter, or device disclosed herein or perform any method disclosed herein. There may be provided a non-transitory computer readable media including a computer program product, which when run on a computer, causes the computer to configure a controller to perform a method as set forth hereinabove. The computer program may be a software implementation, and the computer may be considered as any appropriate hardware, including a digital signal processor, a microcontroller, and an implementation in read only memory (ROM), erasable programmable read only memory (EPROM) or electronically erasable programmable read only memory (EEPROM), as non-limiting examples. The software implementation may be an assembly program.

The computer program may be provided on a computer readable medium, which may be a physical computer readable medium, such as a disc or a memory device, or may be embodied as a transient signal. Such a transient signal may be a network download, including an internet download.

These and other aspects of the invention will be apparent from, and elucidated with reference to, the embodiments described hereinafter.

BRIEF DESCRIPTION OF DRAWINGS

Embodiments will be described, by way of example only, with reference to the drawings, in which FIG. 1 CIE 1931 chromaticity chart;

FIG. 7 shows a simplified table of colour corner values, scaling factor, and scaled colour corner values for various input settings.

Figure 1:
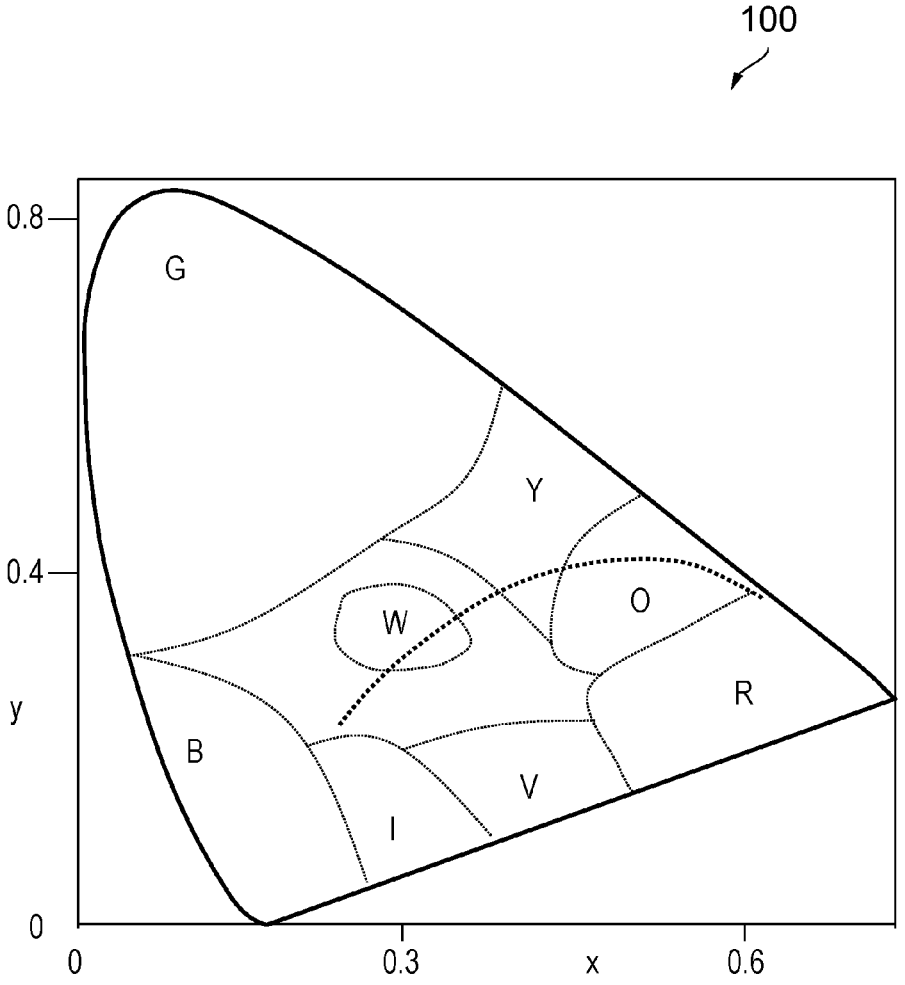
FIG. 1 (PRIOR ART)

It should be noted that the Figures are diagrammatic and not drawn to scale. Relative dimensions and proportions of parts of these Figures have been shown exaggerated or reduced in size, for the sake of clarity and convenience in the drawings. The same reference signs are generally used to refer to corresponding or similar features in modified and different embodiments

DETAILED DESCRIPTION OF EMBODIMENTS

In the following description, first of all correction for three colour RGB lamps will be described, and this will be followed by a description of correction for four colour RGBW lamps.

Figure 2:
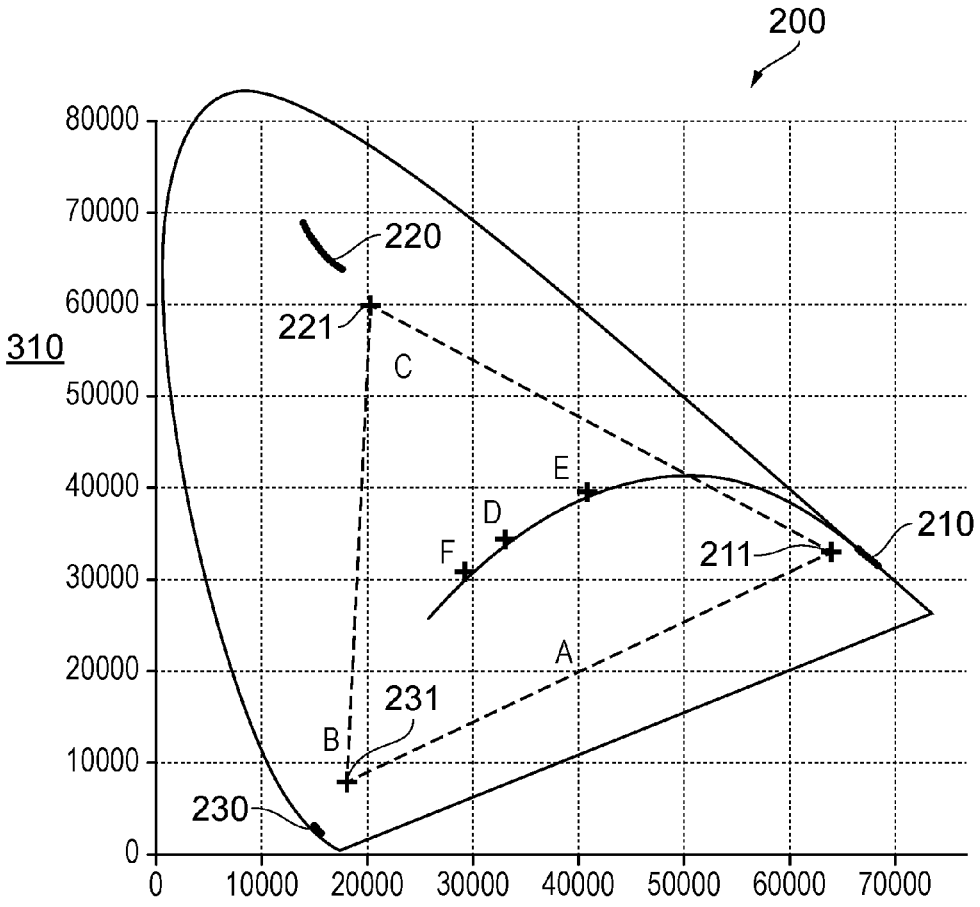
FIG. 2 shows various colour points on the chromaticity chart, illustrating the concept of a colour corner.

Turning to FIG. 2, this shows the familiar CIE 1931 chromaticity chart 200, the figure also shows, at 210, 220 and 230, the XY coordinates of the output of the typical red, green and blue LEDs respectively, under varying operating conditions. As is clear from the figure, the light output from each of the LEDs does not have a fixed chromaticity, that is to say it is not represented by a single point on the chart. Rather, it varies with operating conditions, and in particular with the junction temperature of the LED.

Moreover, and although this is not shown on the chart, it is also the case that the luminance—that is to say the intensity—of the light output from each LED also varies with its junction temperature.

Figure 3:
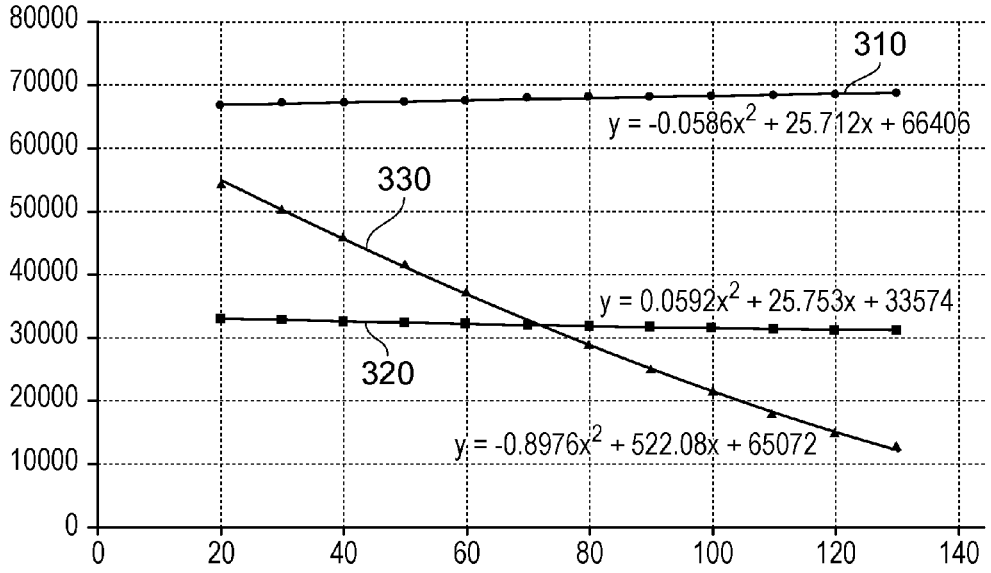
FIG. 3 shows the variation of chromaticity and intensity of an LED with junction temperature.

The variation of the x-coordinate, y-coordinate and luminance of an LED with operating temperature can be measured: FIG. 3 shows the results of an experimental characterisation of a red LED for each of the x-coordinate (at 310) y-coordinate (at 320) and luminance (at 330) plotted against temperature on the x-axis or abscissa. The variation may be approximated by fitting a second-order polynomial (quadratic) of the form $ax^2+bx+c$ to the experimental data for the relative LED shown in FIG. 3 the data may be fitted by:

$$x\text{-coordinate}(\times 10^5)=(-0.0586)\cdot T^2+(25.712)\cdot T+(66406), \quad (1)$$

$$y\text{-coordinate}(\times 10^5)=(0.0592)\cdot T^2+(25.753)\cdot T+(33574), \quad (2)$$

$$\text{and luminance}(\times 10^2)=(-08976)\cdot T^2+(-522.08)\cdot T+(65072). \quad (3)$$

These 9 fitting parameters thus define the operation of the red LED. So for three LEDs a total of 27 parameters are required (and for four LEDs, as will be discussed below, a total of 36 parameters are used).

Turning back to FIG. 2, there are also shown three fixed points on the chromaticity chart, 211, 221 and 231. As will be explained in more detail below, these fixed points may be described "colour corners", Rc{ }, Gc{ } and Bc{ } respectively, corresponding to "virtual LEDs". The area defined by these colour corners is a triangle.

For the avoidance of doubt, reference signs R, G, B, Rc, Gc and Bc (with or without brackets, e.g. R, or R(T), will be used hereinbelow to refer to a scalar value (magnitude) for instance a setting (between 0 and 255 for 8 bit control) for an LED (or virtual LED); conversely, the same term including braces, such as Rc{x,y}, or Rc{ } for short, will be used to refer to the chromaticity position (such as on the CIE chart) of that LED or virtual LED. Then, for example, R{ } is a function of temperature—since it depends on operating temperature, whilst Rc{ } is not a function of temperature since it's position is fixed; conversely the value of the red LED and the virtual red LED or both may depend on temperature: R=R(T) and Rc=Rc(T).

The skilled person will appreciate that in the ideal case of three perfect light sources Rp, Gp, Bp, each having a chromaticity Rp{ }, Gp{ }, Bp{ } independent of operating conditions and located one at each of these three corners, any colour within the triangle may be achieved by mixing the outputs of the perfect light sources Rp, Gp, Bp:

So, for example, if each or Rp, Gp, Bp can take value from 0-255 (corresponding to eight bit digital control) light with chromaticity at point A may be achieved by (255, 0, 255); chromaticity at point B by (0, 10, 205), and chromaticity at point C by (20, 255, 20) and chromaticity at point D by (255, 255, 255).

The chromaticity values of each of the actual LEDs at any given temperature (that is to say, R{ }, G{ }, and B{ }), may be determined using the quadratic fitting parameters described above. Then, provided that, for all temperatures, the chromaticity value of each of the actual LEDs is suitably positioned outside of the triangle formed by the colour corners, the chromaticity of the actual LEDs may be "corrected", so that they have the chromaticity of the colour corners Rc{ }, Gc{ } and Bc{ } respectively, by adding a small amount of light from the other LEDs, to each LED. The skilled person will appreciate that it is necessary that the chromaticity of each of the physical LEDs falls outside the triangle defined by the colour corners: if the actual LED chromaticity was inside the triangle, the corner could only be reached by subtracting light from one or both of the other LEDs—which of course is physically not possible. Furthermore, the chromaticity of each of the physical LEDs has to be positioned with respect to the corners of the triangle, to avoid any requirement for correction by subtraction: e.g. the actual green LED should be to the left from the Bc-Gc line and above Gc-Rc line, etc. It is thus possible to consider the colour corners as "virtual" LEDs, Rc{ }, Gc{ } and Bc{ }, replacing the actual, or real, red, green and blue LEDs.

To aid the understanding of this concept, consider an example, in which the red, green and blue LEDs are each operating at a temperature T1, at which Temperature the R colour corner, at R{ } requires addition of 10% green and 10% blue to the red LED—so is achieved by control setting, for instance, (100, 10, 10); G colour corner at Bc{ } requires addition of 6% red and 10% blue to the green LED—so is achieved by control setting, for instance, (6, 100, 10); and the B colour corner at B{ } requires addition of 2% red and 1% green to the green LED (so is achieved by control setting, for instance, (2, 1, 100). Then, for requested (100, 0,0), then corrected control would be:

$$Rc(100)+Gc(0)+Bc(0),$$

i.e. (100,10,10)+(0,0,0)+(0,0,0)=(100,10,10).

Similarly, for requested (100, 50, 200), then the corrected control would be:

$$Rc(100)+Gc(50)+Bc(200),$$

i.e. (100,10,10)+(3,50,5)+(4,2,200)=(107,62,215).

Before considering in detail the control of 4-LED lamps, it should be noted that as shown, the position D in the CIE chart, corresponding to (255, 255, 255) may lie in the centre of the chart and thus corresponds to white light. By suitable choice of the colour corners, which define the centroid of the triangle, and provided that the same light intensity results from each corner when a maximum setting ("255" in this case) is selected for that corner, this position D may be positioned on the black body radiation curve. For definiteness, it will be assumed that this position is chosen to correspond to 5700K black-body radiation, although the skilled person will appreciate that a different colour temperature may equally be chosen. It should also be noted that, by providing different weighting (for "255") to each of the corners, the position may be adjusted within the triangle—that is to say, it is not necessarily at the centroid.

Returning to the idealised case in which each of the three colour corners corresponds exactly to a single LED, it will be appreciated that the x- and y-coordinates of the light resulting controlling the R, G, B at (255, 255, 255) are the same as those resulting from control at (128, 128, 128)—that is to say, the light output is at the 5700K white point, D in FIG. 2. However, the luminance of the two control points is different. If there was available an LED which produced white light at 5700K, it would be possible to use this instead of the three RGB LEDs—or indeed the white LED could be used in combination with the RGB LEDs. The control setting of the white LED introduces a further degree of freedom. So, if the control values of R, G, B, W are given by the 4-vector, (Xr, Xg, Xb, Xw), where Xr is the control setting of the (notional) 5700K white LED, (& assuming for the moment that the luminance of the notional 5700K white LED is the same as that the RGB combination), then the same output could be achieved by a range of control settings:

i.e: (254,254,254,0)=(127,127,127,127)=(10,10,10, 244), etc.

White LEDs can be designed to have correlated colour temperatures (CCT) of around 2700K—these are called warm white (ww) LEDs—or a higher temperature, of around 6500K—such LEDs are termed cool white (cw). Further, just as the colour coordinates and luminance of colour LEDs vary with temperature, so do those of a white LED.

The concept of a "white corner" will now be introduced. The white corner Wc{ } is the position on the CIE 1931 chart, which corresponds to a correlated colour temperature of, in this example, 5700K. At this point it should be noted that a correlated colour temperature may be chosen which is different to 5700K, but for definiteness that temperature will be used hereinbelow. By extension, it is not strictly necessary that the white corner Wc{ } even lies on the blackbody radiation curve and thus need not have a well-defined correlated colour temperature. However as will become apparent hereinbelow, the temperature on the blackbody curve will generally be effective. The white corner corresponds to the chromaticity of a "virtual" white LED.

In FIG. 2, the position of warm white is shown (approximately) at E, and that of cool white at position F. As a result, it is possible, by adding some light from the blue and green LEDs (or even from the virtual blue, and the virtual green LED at the respective blue corner Bc{ } and green corner Gc{ }), to a warm white, one can "correct" the position of the white LED, on the CIE 1931 colour chart, to the 5700K white corner. Conceptually, adding light from the blue LED "pulls" the position of colour coordinates of the combination towards the blue LED quarters, and adding light from the green LED "pulls" the position of the coordinates of the combination towards the green LED. Nothing would be gained by adding light from the red LED, since this would have the effect of "pulling" the position of the coordinates away from the white corner coordinates. Similarly, it is possible to "correct" the position of a cool white LED to that of the white corner by adding light from the green and red LEDs (or even from the virtual green and the virtual red at the respective green corner Gc{ } and red corner Rc{ }).

R, G, B, may be defined as the requested intensity of red, green and blue light. Then, for instance, if 8 bit control is used, R is a scalar quantity which may take the values between 0 and 255. Similarly, for 12 bit control, R may take any value between 0 and 4095.

When the lamp is operating at maximum brightness at the white corner (which in this example corresponds to a CCT of 5,700K), one may define a white fraction, WF, at the fraction of the total luminance, which is provided by the white LED, as follows:

If $\text{lum}(X_{5700K})$ is defined as the luminance produce by a virtual LED "X" at a chromaticity point of 5,700K CCT, then $$\text{lum(total)}=[(\text{lum}(Rc_{5700K}\{\ \})+\text{lum}(Gc_{5700K}\{\ \})+\text{lum}(Bc_{5700K}\{\ \})]+\text{lum}(Wc,_{5700K}\{\ \}) \quad (4)$$

Then WF is defined through:

$$WF=\text{lum}(Wc,_{5700K}\{\ \})/\text{lum(total)} \quad (5)$$

Similarly, a colour fraction CF, may be defined as the compliment (1−WF):

$$CF=[(\text{lum}(Rc_{5700K}\{\ \})+\text{lum}(Gc_{5700K}\{\ \})+\text{lum}(Bc_{5700K}\{\ \})]/\text{lum(total)} \quad (6)$$

Figure 4:
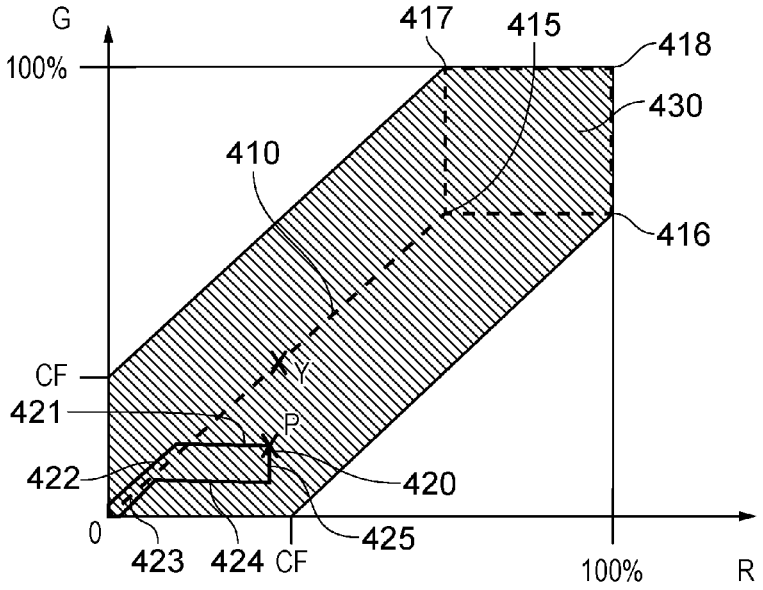
FIG. 4 plots the red-green plane, in the colour control space.

Turning now to FIG. 4, in this figure is plotted the red-green plane, in the colour control space. In practice, a more realistic representation would be given by providing a three-dimensional picture with red, green and blue orthogonal axes, but the general principle may be understood more clearly by considering only two colours. The distance of any specific point from the origin is indicative of the intensity of light, and the angle from the origin is indicative of the relative intensity of red and green light. So, any point in the X axis is made up entirely of red light from the red LED, and any point on the y-axis is made up entirely of green light from the green LED. Any point on the diagonal line 410 starting from the origin is an equal mix of red and green light. However, since an equal mix of red and green light corresponds to white light (neglecting the influence of blue light, since this figure is a two dimensional projection onto the red-green plane), a point on the diagonal line may equally be provided from a white LED. The end 415 of the diagonal line 410 corresponds to the white LED being at its maximum intensity or "range" (which for 8-bit control would be 255, and for 12-bit control may be 4095).

If red light is added to the white LED which is already at its range, the colour point moves along the line 415 to 416, until, at position 416, the red LED is fully on (i.e. it is at its own range (255 for 8 bit control, etc.). Conversely, if green light is added to the white LED (already at its range), the colour points moves along the line 415 to 417, until, at position 417, the green LED is fully on (i.e. it is at its own range (255 for 8 bit control, etc.). Adding in green, from position of 416, or red light from position 417, moves the colour point vertically or horizontally respectively until it reaches pints 418, at which all the LEDs are at their maximum range.

Consider now point P 420. This may be achieved in several ways. For instance a combination of white light, as shown at 422, and red light, shown at 421, could be used. Alternatively, a smaller amount of white light shown at 423, plus more red light shown at 424, plus green light shown at 425 may be used. The combination of intensity and colour shown at P could even be achieved without using the white light at all, but by a combination of just the red and green. It will be recognised that, from one point to view, any point in the square bounded by the origin and point Y 426 may be formed by red and green light only, and the addition of increasing amount of white light translate this square of accessible colour-intensity combinations along the diagonal, to result in the shaded region. Thus, the shaded part of the plot represents all the colour intensity combinations which can be achieved using the red, green and white LEDs.

According to one or more embodiment of the present disclosure, the use of the white LED is optimised—that is to say a maximal amount of white light is provided thereby—in the selection of the settings of the LEDs to achieve any given requested control setting. As can be seen visually from FIG. 4, this may be achieved, for many requested colours, by choosing the white light setting to be equal to the smaller of the red and green control setting (scaled by a factor 1/WF to compensate for the fact that Wc( ) has less luminance than the complete lamp. So Wc is set to a higher value to produce same lumen output. And then adding respectively green or red light to the white lights, results in the requested control setting. Extending this to the situation of three colour LEDs and a requested (R, G, B) control setting, then the value of the white LED W is chosen to be equal to Min(R,G,B)/WF. Conceptually, the scaling factor 1/WF is included to take account of the fraction of white lumen that can be generated by the white corner. For instance, suppose RGB of (10, 10, 10) is requested, at a white fraction WF=0.1. To make this white light (10, 10, 10), Wc has to be set to 100. Note that is WF=1 (a lamp which a very powerful Wc), the Wc has to be set to 10 only.

In practice, since LEDs are not ideal, in the sense that their chromaticity and intensity vary with operating temperature, the above approach may be based on the virtual LEDs.

It will be appreciated, that if the requested control setting falls in the square 430 to the top right of the FIG. 4, that is to say, it is beyond the diagonal line for 410, then the white LED is insufficient to meet this requested value. In that case, Wc is set to its maximum ("range").

So, in summary an optimum solution may be achieved by $$Wc=\text{Min}(R,G,B)/WF \text{ for } Wc<\text{range}$$

$$Wc=\text{range, otherwise.}$$

Recalling that the brightness of the light is represented by the distance of the chosen colour point from the origin, it will be apparent from FIG. 4, that equal brightness is not achievable for all colour combinations. For some chosen colour intensity combinations, such as P2 shown at 510 in FIG. 5, the above method would result in requesting more coloured light than is available from the LED—for example in FIG. 5, the requested green lights would not be available from the green LED, which as a result could only provide sufficient light to provide the output at, at best, colour-intensity combination P3. Since this position is at a different angle from the origin to the requested P2, the user would experience a different chromaticity to that requested.

To determine the setting for the colour LEDs, the concept of "colour corner" described above may be used, based on the correction (subtraction) to take into account the use of white light: a setting at the red colour corner, for the red light:

$$Rc=(R-Wc*WF)/CF=(R-Wc*WF)/(1-WF).$$

Similarly, for green and blue:

$$Gc=(G-Wc*WF)/CF=(G-Wc*WF)/(1-WF),$$

$$\text{and } Bc=(B-Wc*WF)/CF=(B-Wc*WF)/(1-WF).$$

This aspect of the present disclosure may be more clearly understood with reference to FIG. 7 which shows a table of values Wc for the white corner and Rc, Gc and Bc for the respective coloured corners, for various requested inputs R, G, B, on separate rows 701-716 (for 8 bit control). It should be noted that this table does not include any correction for operating temperature, or for scaling, as will be discussed in more detail hereinbelow. The table includes two sets of data corresponding to different values of the white fraction WF, specifically, wherein the white LED may provide one half of the total output (corresponding to a wide fraction WF of 0.5) or one three quarters of the total output (corresponding to a white fraction WF of 0.75).

As will be apparent from the table, in the case that the maximum setting is requested from all of R, G and B, the maximum output is provided from Rc, Gc, Bc and Wc. (rows 701 and 709). In the case that the requested setting includes no light from one or more of R, G and B, as shown in rows 702, 703, 710 and 711, then the white LED does not contribute (Wc=0). For equal contributions of R, G and B, less than the maximum, the light that will be provided by the white LED, its intensity being determined by the relevant white fraction (as shown at rows 704 and 712). Otherwise, the intensity of white is set by the minimum requested value of R, G and B divided by the white fraction WF—the corresponding colour LED is then set to 0, and the settings of the other two coloured LEDs are determined by subtracting the contribution of the white light and dividing by the colour fraction CF=1−WF, as shown, for instance, at rows 707 and 715.

According to one or more embodiments, a correction may be made to the intensity, rather than the chromaticity of the achieved light, in order to improve the user experience. In a first, straightforward, embodiment the intensity is simply clipped, to lie along the boundary of the achievable or allowed colour intensity space (that is to say, the shaded area in FIG. 4). In particular, since the calculation for the settings of any of Rc, Gc and Bc described above may results in values of which lie outside their allowed range, the intensity (of all the LEDs) may require to be scaling: this may be done by applying a scaling factor F1 to each of the output control settings, where F1 is given by $$F1=\text{range}/(\text{Max}(Rc,Gc,Bc).$$

The output control settings then results in light at position P4.

Figure 5:
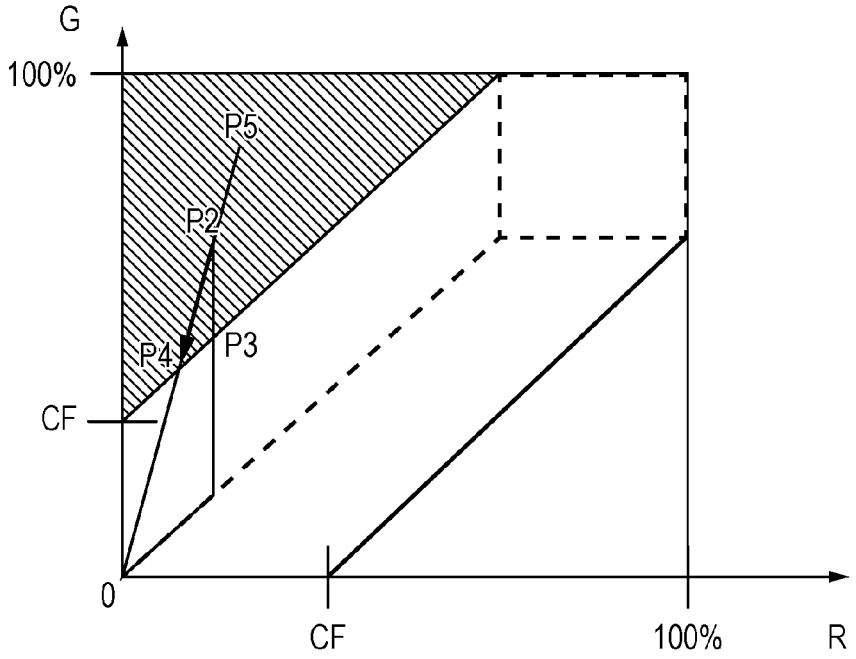
FIG. 5 plots the same red green plane, and illustrates a scaling factor.

This scaling is only required if the requested light is in the shaded area in FIG. 5. So is only applied when Max(Rc, Gc, Bc)>range; otherwise the scaling F1=1.

Combining: F1=range/(Max(Rc, Gc, Bc), when Max(Rc, Gc, Bc)>range;

F1=1, otherwise.

Although such methods may be simple to implement, they result in clipped intensities, with no further intensity control, once the boundaries of the accessible intensity-colour region had been reached. Thus a user would "see" the same output irrespective of whether position P2 or P5 had been requested: any requested increase or decrease in intensity would have no effect.

Figure 6:
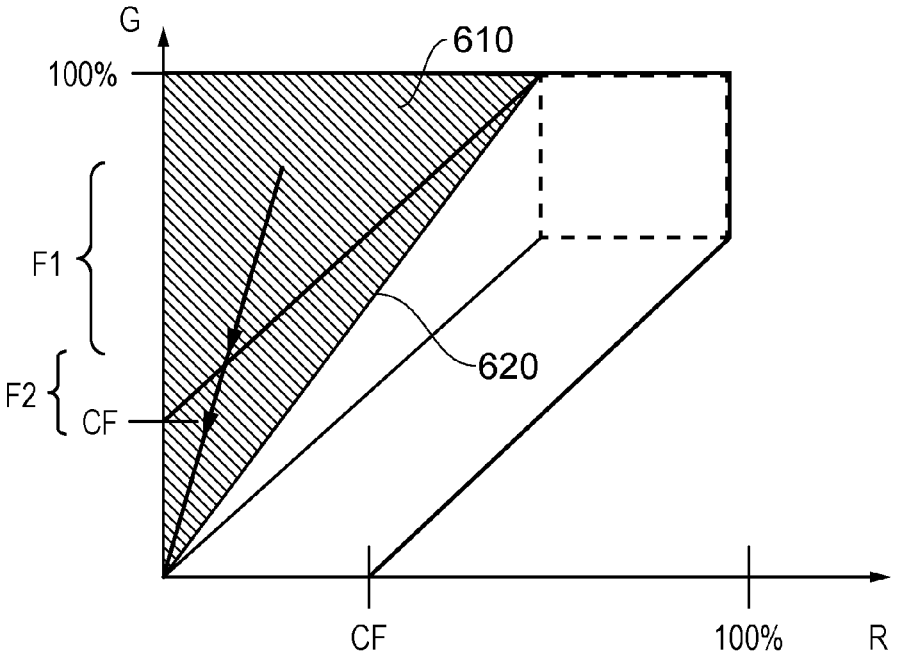
FIG. 6 plots the same red green plane, and illustrates another scaling factor.

This may be avoided in one more embodiments by applying a further scaling factor, in combination with the scaling factor F1, as shown in FIG. 6. This second correction is defined through a further scaling factor F2:

$$F2=\text{Max}(R,G,B)/\text{range}.$$

It will be noted that this scaling factor does not utilise the colour corner corrected values of the colour LEDs, but the input requested settings.

Combining the scaling factors F1 times F2, results in an intensity correction which allows control over the complete control space, that is to say, over the whole of the square defined by the origin and 418 in FIG. 4:

$$F=F1\times F2=\text{Max}(R,G,B)/(\text{Max}(Rc,Gc,Bc).$$

This scaling is, similarly, only required if the requested light is in the shaded area in FIG. 6. Should be noted, that to provide proper scaling, rather than clipping as described above, the shaded area in FIG. 6 is larger than that in FIG. 5. So the scale only applied when Max(Rc, Gc, Bc)>Wc; otherwise the scaling F1=1.

So combining these:

$$F=\text{Max}(R,G,B)/(\text{Max}(Rc,Gc,Bc),\text{when Max}(Rc,Gc,Bc)>Wc;$$

$$F1=1,\text{ otherwise.}$$

As a consequence of the scaling factors F1 and F2, an intensity adjustment is made to the output whenever the colour-intensity combination falls within the shaded area 610 shown in FIG. 6. Furthermore, the amount of scaling decreases as the boundary line 620 between the non-scaled and scaled areas is approached: as a result, accurate colour rendering may be achieved, without the observable clipping which would be observed in embodiments which only use the scaling factor F1.

The required settings for each of the LEDs may now be calculated, at the operating temperature. The operating temperature may be determined either by directly measuring the LED, or by techniques such as the "sensorless sensing" techniques developed by the present Applicant. In this technique a forward voltage of the LED junction is measured whilst the LED is in a quiescent, or "off" state part of PWM control, by a passing a low current through the LED in this state, and using the variation of the P-N junction's IV characteristic curve with temperature to determine the junction temperature. As already explained above with reference to RGB lamp control, by using a fixed chromaticity colour corner concept—Rc{ } for red—say, the required contribution from each of the red, blue and green LEDs (respectively R(Rc{ }), G(Rc{ }), B(Rc{ })) to provide the required intensity at this colour corner from the LEDs having respective temperatures TR, TG, TB is given by:

$$Rc=R_{TR}(Rc\{\ \})+(G_{TG}(Rc\{\ \})+B_{TB}(Rc\{\ \})$$

$$\text{Similarly, } Gc=R_{TR}(Gc\{\ \})+(G_{TG}(Gc\{\ \})+B_{TB}(Gc\{\ \}),$$

$$\text{and } Bc=R_{TR}(Bc\{\ \})+(G_{TG}(Bc\{\ \})+B_{TB}(Bc\{\ \}),$$

Finally, the white corner is similarly corrected for temperature, in the case of a warm white, by adding contributions from the red green and blue LEDs:

$$Wc=W+G_{TR}(Wc\{\ \})+B_{TR}(Wc\{\ \}).$$

And in the case of a cool white LED, contributions from the red and green LEDs are added to the white LED contribution:

$$Wc=W+R_{TR}(Wc\{\ \})+G_{TR}(Wc\{\ \}).$$

The respective output Ro, Go, Bo required from each coloured LED is then the sum of the respective contributions. That is to say, Ro is the output that is needed from the red-LED-at-temperature-TR to create the corners:

$$Ro=R_{TR}(Rc\{\ \})+R_{TR}(Gc\{\ \})+R_{TR}(Bc\{\ \})+R_{TR}(Wc\{\ \});$$

$$Go=G_{TR}(Rc\{\ \})+G_{TR}(Gc\{\ \})+G_{TR}(Bc\{\ \})+G_{TR}(Wc\{\ \});$$

$$Bo=R_{TR}(Rc\{\ \})+B_{TR}(Gc\{\ \})+B_{TR}(Bc\{\ \})+B_{TR}(Wc\{\ \});$$

Since the contribution of the white LED has, at the beginning of the process, been separated from the contribution of the coloured LEDs, the white LED output, Wo, is given simply by $$Wo=Wc_{TW}$$

In the case that the LED are controlled using pulse width modulation (PWM), the PWM duty cycle may now be determined from the outputs Ro, Go, Bo, and Wo: the duty cycle of the PWM control for each LED is directly proportional to the respective output Ro, Go, etc.

The present disclosure further extends to controllers configured to operate methods as described above. The temperature correction for each of the LEDs may be carried out using a lookup table; however for typical implementations which may use 12 bit control (for example), the lookup table may become very large. In one or more embodiments, even though not required for practicing the embodiments described herein, a microcontroller IC, such as the JN5168, and JN5169 microcontroller available from NXP semiconductors, may be used. The LED driver control may then be performed via four channel PWM output from the microcontroller. Calculations associated with the method can then for example be provided to a customer in the form of a precompiled library.

Figure 8:
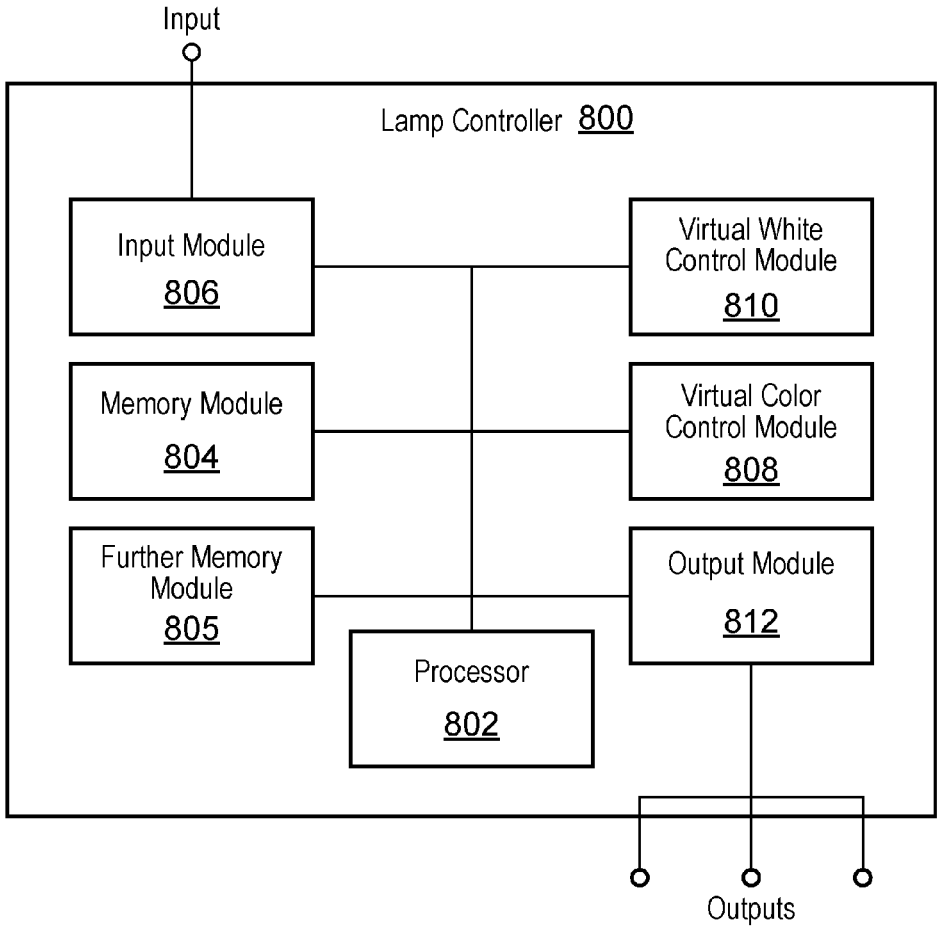
FIG. 8 shows a controller for a lamp.

A controller is shown in FIG. 8. FIG. 8 shows a controller 800 for a lamp comprising first, second, third colour LEDs and a white LED, the controller comprising: a memory module 804 for storing data indicative of the variation of chromaticity and luminosity of each of the LEDs as a function of temperature over an operating temperature range; and a further memory module 805 for storing data indicative of the chromaticity of each of a virtual first, virtual second, virtual third and a virtual white LED. The chromaticities may be such that the chromaticity of each virtual LED can be achieved by combining light from the first, second and third LEDs for all temperatures within the operating range, and the chromaticity of the virtual white LED can be achieved by combining light from the white LED with light from a two of the first, second and third LEDs, for all temperatures within the operating range. The data indicative of the variation of chromaticity and luminosity of each of the LEDs as a function of temperature over an operating range may be determined in a pre-calibration phase, for example this may be carried out for a specific type of LED. This information may be preloaded into the controller, before the controller is shipped to a lighting circuit manufacturer; in other embodiments the data may be uploaded into controller as part of the lighting circuit manufacturing process; without limitation, the data may take the form of a look-up table or as a precompiled library.

The controller may further comprise an input module 806, configured to receive data representative of a requested setting R, G, B of each of three primary colours, thereby defining a requested chromaticity and a requested luminance, and to receive data indicative of an operating temperature of each LED. The input module may typically receive digital data. The requested settings may each typically be in the form of an 8 or 12 bit value. In other embodiments, the input module may receive analogue data. In that case it may be convenient for the input module to convert the analogue data into digital data.

The controller may further comprises a virtual white control setting module 810 configured to determine a control setting of the virtual white LED corresponding to a maximum fraction of a total luminance at the requested chromaticity which can be provided by the virtual white LED, and a virtual colour control setting module 808 configured to determine a control setting for each of the respective first, second and third virtual LEDs, in dependence on the difference between the requested setting of the respective primary colour and the control setting of the virtual white LED.

Finally, the controller may further comprise an output module 812 configured to output a respective output control setting for each of the first, second and third LED which is sum of the respective first, second or third components of the virtual white, virtual first, virtual second and virtual third LED control settings at the operating temperature and an output control setting for the white LED which is the white LED component of the virtual white LED.

Some of the functions mentioned above may be carried out in a processor 802.

The output module may supply the respective output control settings directly to a, or a respective, pulse width modulation (PWM) generator or modulator, for generating or modulating a PWM signal to control the respective LED. Such PWM generators modulators will be familiar to the skilled person. In other embodiments, the output module may supply the respective output control settings to a current generator, to supply a constant current, at a level determined by the respective output control setting, to each respective LED.

The skilled person will appreciate that the term "LED" as used herein may be broadly defined, to encompass not only a single light emitting junction, but also a plurality of light emitting junctions arranged in parallel to provide greater intensity. Furthermore, the term may also extend, without limitation, to a series connected "string" of light emitting junctions.

From reading the present disclosure, other variations and modifications will be apparent to the skilled person. Such variations and modifications may involve equivalent and other features which are already known in the art of LED lighting controllers, and which may be used instead of, or in addition to, features already described herein.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub-combination. The applicant hereby gives notice that new claims may be formulated to such features and/or combinations of such features during the prosecution of the present application or of any further application derived therefrom.

For the sake of completeness it is also stated that the term "comprising" does not exclude other elements or steps, the term "a" or "an" does not exclude a plurality, a single processor or other unit may fulfil the functions of several means recited in the claims and reference signs in the claims shall not be construed as limiting the scope of the claims.

The invention claimed is:

1. A method of controlling a lamp comprising first, second and third colour LEDs and a white LED, the method comprising:

characterising the variation of chromaticity and luminosity of each of the LEDs as a function of temperature over an operating temperature range;

defining each of a virtual first, virtual second and virtual third LED, such that the chromaticity of each virtual LED is achieved by combining component light from the first, second and third LEDs for all temperatures within the operating range;

defining a virtual white LED, such that the chromaticity of the virtual white LED is achieved by combining light from the white LED with light from a two of the first, second and third LEDs, for all temperatures within the operating range;

receiving data representative of a requested setting R, G, B of each of three primary colours, thereby defining a requested chromaticity and a requested luminance;

determining an operating temperature of each LED;

determining a virtual white control setting corresponding to a maximum fraction of a total luminance at the requested chromaticity which is provided by the virtual white LED;

determining a control setting for each of the respective first, second and third virtual LEDs, in dependence on the difference between the requested setting of the respective primary colour and the control setting of the virtual white LED;

controlling each of the first, second and third LED with a respective output control setting which is a sum of the respective first LED, second LED or third LED component light of the virtual white, virtual first, virtual second and virtual third LED control settings at the operating temperature;

and controlling the white LED with an output control setting which is the white LED component of the virtual white LED.

2. A method as claimed in claim 1, further comprising scaling the control setting Rc, Gc and Bc, Wc of each virtual LED by a scale factor equal to the ratio of the maximum of Rc, Gc and Bc to the maximum allowable Rc, Gc and Bc, to the maximum of Rc, Gc and Bc, in the event only that Max(Rc, Gc, Bc)>range, according to:

scale factor=range/Max (Rc, Gc, Bc), where range is defined by a maximum allowable control setting for any of the colour LEDs.

3. A method as claimed in claim 1, further comprising scaling the control setting Rc, Gc and Bc, Wc of each LED, by a scale factor equal to the ratio of the maximum of R, G and B to the maximum of Rc, Gc and Bc, in the event only that Max(Rc, Gc, Bc)>Wc, according to $$\text{scale factor}=\text{Max}(R,G,B)/\text{Max}(Rc,Gc,Bc).$$

4. A method as claimed claim 1, wherein the virtual white control setting Wc is determined according to $$Wc=\text{Min}(R,G,B)/WF$$

provided at least one of R, G, and B is less than a white fraction WF, and maximum otherwise, where the white fraction WF is defined as the maximum fraction of the luminance of the lamp which may be provided from the white LED, when operated at its maximum brightness at the virtual white chromaticity.

5. A method as claimed in claim 4, wherein the virtual first, virtual second and virtual third control setting Rc, Gc and Bc respectively to be provided by each of the respective virtual LEDs are respectively determined according to $$Rc=(R-Wc*WF)/(1-WF);$$

$$Gc=(G-Wc*WF)/(1-WF), \text{ and}$$

$$Bc=(B-Wc*WF)/(1-WF).$$

6. A method as claimed in claim 1, wherein determining an operating temperature of each LED comprising measuring a voltage across the LED at an operating current which is no more than 1/1,000 of a normal operating current for the LED.

7. A method as claimed in claim 1, wherein the white LED is a warm white LED and the virtual white LED is defined such that the chromaticity of the virtual white LED is achieved by combining light from the white LED with light from the second and third LEDs, for all temperatures within the operating range.

8. A method as claimed claim 1, wherein the white LED is a cool white LED and the virtual white LED is defined such that the chromaticity of the virtual white LED is achieved by combining light from the white LED with light from the first and second LEDs, for all temperatures within the operating range.

9. A method as claimed in claim 1, wherein the virtual white LED has a chromaticity corresponding to a correlated colour temperature of 5,700K.

10. A method as claimed in claim 1, wherein the first, second and third colour LEDs are respectively a red, green and blue LED, and the virtual first, virtual second and virtual third LED are respectively a virtual red, virtual green and virtual blue LED.

11. A non-transitory computer readable media including a computer program product, which when run on a computer, causes the computer to configure a controller to perform a method as claimed in claim 1.

12. A controller for a lamp comprising first, second, third colour LEDs and a white LED, the controller comprising:

a memory module for storing data indicative of the variation of chromaticity and luminosity of each of the LEDs as a function of temperature over an operating temperature range;

a further memory module for storing data indicative of the chromaticity of each of a virtual first, virtual second, virtual third and a virtual white LED, such that the chromaticity of each virtual LED is achieved by combining light from the first, second and third LEDs for all temperatures within the operating range, and the chromaticity of the virtual white LED is achieved by combining light from the white LED with light from a two of the first, second and third LEDs, for all temperatures within the operating range;

an input module, configured to receive data representative of a requested setting R, G, B of each of three primary colours, thereby defining a requested chromaticity and a requested luminance, and to receive data indicative of an operating temperature of each LED;

a virtual white control setting module configured to determine a control setting of the virtual white LED corresponding to a maximum fraction of a total luminance at the requested chromaticity which is provided by the virtual white LED;

a virtual colour control setting module configured to determine a control setting for each of the respective first, second and third virtual LEDs, in dependence on the difference between the requested setting of the respective primary colour and the control setting of the virtual white LED; and an output module configured to output a respective output control setting for each of the first, second and third LED which is sum of the respective first, second or third components of the virtual white, virtual first, virtual second and virtual third LED control settings at the operating temperature and an output control setting for the white LED which is the white LED component of the virtual white LED.

13. A controller as claimed in claim 12, further comprising a scaling module, configured to either:

(a) scale the control setting Rc, Gc and Bc, Wc of each virtual LED by a scale factor equal to the ratio of the maximum allowable Rc, Gc and Bc to the maximum of Rc, Gc and Bc, in the event only that Max(Rc, Gc, Bc)>range, according to: scale factor=range/Max (Rc, Gc, Bc), where range is defined by a maximum allowable control setting for any of the colour LEDs; or (b) to scale the control setting Rc, Gc and Bc, Wc of each LED, by a scale factor equal to the ratio of the maximum of R, G and B to the maximum of Rc, Gc and Bc, in the event only that Max(Rc, Gc, Bc)>Wc, according to: scale factor=Max (R, G, B)/Max (Rc, Gc, Bc).

14. A controller as claimed in claim 12, wherein (a) the virtual white control setting module is configured to determine the virtual white control setting Wc is determined according to $$Wc=\mathrm{Min}(R,G,B)/WF$$

provided at least one of R, G, and B is less than a white fraction WF, and maximum otherwise, where the white fraction WF is defined as the maximum fraction of the luminance of the lamp which may be provided from the white LED, when operated at its maximum brightness at the virtual white chromaticity; and (b) the virtual colour control setting module is configured to determine the virtual first, virtual second and virtual third control setting Rc, Gc and Bc respectively to be provided by each of the respective virtual LEDs are respectively determined according to $$Rc=(R-Wc*WF)/(1-WF);$$

$$Gc=(G-Wc*WF)/(1-WF), \text{ and}$$

$$Bc=(B-Wc*WF)/(1-WF).$$

15. A LED lighting circuit comprising first, second, third and white LEDs, and a controller as claimed in claim 12.

* * * * *